US005356087A

United States Patent [19]

Smith et al.

[11] Patent Number: 5,356,087

[45] Date of Patent: Oct. 18, 1994

[54] METHOD AND DEVICE FOR AUTOMATIC SLEEVE FEED TO ROLL-CUTTING MACHINES OF THE SUPPORT ROLLER TYPE

[75] Inventors: Philip W. Smith, Beloit, Wis.; Jürgen Treutner, Ostfildern; Gerhard W. Dörfel, Boll, both of Fed. Rep. of Germany

[73] Assignee: Beloit Technologies, Inc., Wilmington, Del.

[21] Appl. No.: 952,622

[22] PCT Filed: May 26, 1990

[86] PCT No.: PCT/EP90/00849

§ 371 Date: Nov. 25, 1992

§ 102(e) Date: Nov. 25, 1992

[87] PCT Pub. No.: WO91/18815

PCT Pub. Date: Dec. 12, 1991

[51] Int. Cl.[5] ..... B65H 19/30

[52] U.S. Cl. ..... 242/525; 242/530.4; 242/533; 242/541

[58] Field of Search ..... 242/56.4, 56.2, 56.5, 242/65, 56.9

[56] References Cited

U.S. PATENT DOCUMENTS

| | | | |
|---|---|---|---|
| 4,932,599 | 6/1990 | Doerfel | 242/56.4 |
| 4,951,900 | 8/1990 | Goerner | 242/56.2 |
| 4,988,052 | 1/1991 | Urban | 242/56.4 |
| 5,022,597 | 6/1991 | Morizzo | 242/65 X |

FOREIGN PATENT DOCUMENTS

| | | |
|---|---|---|
| 315568 | 5/1989 | European Pat. Off. . |
| 324709 | 7/1989 | European Pat. Off. . |
| 2136403 | 9/1984 | United Kingdom . |

*Primary Examiner*—Daniel P. Stodola
*Assistant Examiner*—John Q. Nguyen
*Attorney, Agent, or Firm*—Dirk J. Veneman; Raymond W. Campbell; Gerald A. Mathews

[57] ABSTRACT

In a method and apparatus for automatically feeding sleeves in roll cutting machines of the support roller type, a wide web (12) of paper or the like is unwound at an unwinding station (10). At a cutting station (20) the wide web (12) is slit lengthwise into at least two narrower, partial-width webs (24). The narrower, partial-width webs (24) are wound up using winding sleeves (44, 54) at two winding stations (40, 50) arranged either side of the support roller(s) (30) and each comprising at least one winding device (41, 51) so that adjacent partial-width webs (24) are wound at different winding stations (40, 50 respectively). The winding sleeves (44, 54) are pushed in a feeding device (60) into a transfer position oriented parallel to the support roll or rollers (30) in a row one after the other in order to the winding devices to be loaded, distributed from their transfer positions to both sides of the support roller(s) and transported to the loading positions in the winding devices (41, 51), in order to be loaded there for the purpose of later receiving their partial-width webs. The winding sleeves (44, 54) which are in their transfer positions and distributed to both sides of the support roller(s) are taken up by the transport devices (70) arranged at the respective winding devices (41, 51) and raised or lowered along a substantially straight line into the loading positions.

3 Claims, 16 Drawing Sheets

METHOD AND DEVICE FOR AUTOMATIC SLEEVE FEED TO ROLL-CUTTING MACHINES OF THE SUPPORT ROLLER TYPE

BACKGROUND OF THE INVENTION

This invention relates to a method for automatically feeding winding sleeves to a roll-cutting machine of the support roll type, as well as a roll-cutting machine for implementing the method.

In roll-cutting machines of the support roller type, the winding devices are usually so-called centre winders, since the clamping heads gripping the winding sleeves for holding the ends of the cut sheets to be wound are driven in the winding direction. These known roll-cutting machines produce good winding results and have been used in the industry for many years. The production capacity of these machines is greatly limited by the amount of time and effort required to change the rolls/winding sleeves. This procedure takes from five to either minutes and requires up to four or five workers, depending on the number of stations. The average cutting and winding time amounts to approximately 12 minutes. This means that the machine is not productive 30 to 40% of the time (DE 38 00 703 A1).

In roll cutting machines with one support roll as well as in those with two support rolls, with the sheets being fed from below in to the winding station, it is known to feed the winding sleeves automatically from above the support roll(s). According to DE 38 00 703 A1, a feed beam is provided for each of the two winding stations positioned alongside the support roll(s); this feed beam extends across the entire width of the machine, which can be eight to ten meters, and is supported by swivel arms at the end faces of the machines. Each feed beam has a groove for holding the winding sleeves. If the two feed beams are swivelled toward each other and are positioned close together, the two grooves lie so close together that there is room for only one winding sleeve in each longitudinal segment of the feed beam. This makes it possible to alternately transfer the winding sleeves, which are already cut to length, from one feed beam end to the groove on one feed beam or the other an, with the aid of a slide, push the entire unit along the two grooves until it reaches the transfer positions corresponding to the winding fixtures positions. The winding sleeves are thus distributed to the two grooves belonging to each of the winding stations as soon as they are inserted into the grooves. A functionally reliable distribution is difficult in this case. In order to fit the individual winding fixtures with new winding sleeves, the feed beams must be swivelled in an arc in the direction of the support arm pairs for the winding fixtures. While they are being swivelled, the winding sleeves roll into the grooves receiving them from one initial stable position to another stable position, where they are prevented from rolling out of the groove by a swivelling stop. The stops are pivotably attached to the feed beam under a spring loading so that the stop plate positioned in the region of the support arms for the winding fixtures can avoid contact with the support arms.

This known feed device has three primary disadvantages: First, there is a danger that, when the winding sleeves roll from one stable position to the other, the swing (momentum) of the rolling winding sleeves becomes so great that the stop plates whose surfaces are rounded cannot stop this rolling movement. This danger is present primarily with winding sleeves of a relatively large diameter and/or a relatively great weight. Secondly, alignment of the winding sleeves to the clamping heads of the winding fixtures requires great effort, primarily if the winding sleeve diameter has to be changed and/or sleeves of different diameters are to be wound during a single winding cycle. Finally, it is difficult to transfer winding sleeves in different grooves to their precise transfer positions.

Some simplification of the winding sleeve feed device is proposed in DE 37 37 503 A1 for a roll-cutting machine with two support rolls. In this machine, all winding sleeves necessary for a single winding cycle are positioned in a single groove. The winding sleeves are not distributed to the sides corresponding to the two winding stations until the winding sleeves have been placed in their transfer positions corresponding to the winding fixtures. They are distributed by flipping open the groove from below and transferring the winding sleeves to alternating gripping arms which pull the winding sleeves to the correct side and place them on an inclined pane leading to the clamping position of the relevant winding sleeve. These known winding sleeve feed devices also require a stop which prevents the winding sleeve from rolling further and holds it in the precise clamping position. This known winding sleeve feed device requires a relatively large number of moving parts. It also requires a great deal of alignment work when the width of the cut sheets and/or winding sleeve diameters are changed. Finally, when changing the cut sheet widths, the gripping arms must be re-aligned independently, i.e. separately from the winding devices. A box girder extending across the entire width of the machine and having side-mounted guide rails which can be fitted with slides has to be provided for this purpose.

SUMMARY OF THE INVENTION

The invention is therefore based on the problem of providing a method and a device of the type mentioned above to simplify the automatic feed of winding sleeves to the winding fixtures. To solve this problem, this invention proposes a method and apparatus where the winding sleeves are moved translationally along a straight line, either vertically or at an angle to the vertical, by a transport device at each winding station.

Among other things, the invention achieves the following:

The winding sleeves can be precisely and rapidly centred in the centre of the clamping heads and the winding sleeves transported from the transfer to the clamping position;

Adjustment of the holding point of the transport fixture at the clamping position is simple, precise and, in particular, programmable, so that sleeves of different diameters can be used without any problem, i.e. different sleeves on different winding devices as well as—in principle—different sleeves on the same winding fixture from one cycle to another, with the option of fully automating this procedure.

The transport devices according to the invention can be used in roll-cutting machines with a single support roll as well as for roll-cutting machines with two support rolls; likewise, the cut sheets can be fed to the support rolls from below as well as from above.

Rectilinear motion according to the invention, which is a lifting or a lowering motion, does not need to be vertical but can also be carried out at an angle, i.e. with a substantial horizontal component; this is generally necessary when the winding sleeves are advanced to a position above one or both support rolls, i.e. with the cut sheets normally being fed to the support roll(s) from below. In these instances, the winding sleeve must be lowered from their transfer positions on the transport devices to their clamping positions. If, in one of the preferred cases, the feed device for the winding sleeves is positioned beneath the preferably single support roll or beneath the two support rolls, the winding sleeves are lifted from their transfer positions on the transport devices to their clamping positions, and the angle of inclination of rectilinear transport motion can be kept to a minimum in relation to the preferred purely vertical movement; both measures (lifting and small angle of inclination) are advantageous for easy and secure positioning of the winding sleeves in the holders on the transport devices.

An important consideration for the invention is the fact that the transport devices consist of lifting and lowering elements, i.e. transport devices which essentially move along a straight line, such as piston/cylinder arrangements, spindle drives, linear motors and similar rectilinear transport devices which are preferred for this purpose. According to the invention, it is preferred that the transport motion should be exclusively rectilinear, i.e. the angular position of the transport devices in relation to the vertical direction should remain constant throughout the lifting and lowering operation. In principle, however, it is also possible to superimpose a certain swivel motion of the transport device on the lifting or lowering motion.

Each of the winding devices in a roll-cutting machine should be assigned a certain transport device and, in particular, the winding device and its corresponding transport device should always be moved together. In principle, this makes it possible to fit each transport device with a single lifting or lowering element; according to the preferred arrangement, however, each side of each winding device, i.e. particularly each supporting arm, should be assigned its own transport device, with both devices preferably moved as a single unit; each transport device thus consists of two spaced apart lifting and lowering elements. When changing the width of the cut sheets, this eliminates the need to move and/or realign the transport devices separately; likewise, this type of device—as described in greater detail below—makes it possible to transfer the winding sleeve with the holders on the lifting or lowering elements with particular ease, i.e. with little effort, and with precision.

Fundamentally, however, it is also conceivable to fit each winding station, i.e. each side of the support roll(s), with only one pair of lifting or lowering elements and arrange all holders for the winding sleeves intended for the relevant machine side on a cross beam moved jointly by the two lifting/lowering elements, without departing from the basic idea of the invention.

"Grooves" for jointly holding all winding sleeves necessary for the winding fixtures of the winding stations, i.e. for holding a complete set of winding sleeves, are, according to the invention, actual grooves or groove-like holding devices which make it possible to hold all winding sleeves or a set sequentially in their axial direction, particularly so that the winding sleeves can be pushed from one end of the machine and into these "grooves", as described, for example, in DE 38 00 702 A1. In contrast to DE 38 00 702 A1, which stipulates a double groove, this type of groove should have a "single-track" design, i.e. the axes of all winding sleeves should lie on the same straight line or, if the winding sleeves have different diameters, the winding sleeve axes should like on the same vertical plane; with the "groove" described in DE 37 37 503 A1, this is already the case and has an advantage in the fact that, when inserting the winding sleeves into the "groove" from one end of the machine, the sleeves do not need to be distributed to the two sides of the machine, i.e. to the two winding stations, as is required by DE 38 00 702 A1.

The winding sleeves should be removed from the "groove" by the holders of the lifting/lowering elements, preferably by placing the winding sleeve holders of the individual transport devices in their winding sleeve holding positions alongside the groove so that they "grip" the "ejected" winding sleeves. "Ejecting" the winding sleeves at the "groove" has already been generally described in DE 37 37 503 A1 and means that the winding sleeves are advanced, for example, to at least one inclined plane on each side of the machine, over which they roll by their gravitational force, thereby losing height, and that the sleeves assigned to the two winding stations are positioned at a lateral distance from each other. "Gripping" these winding sleeves with the holders according to the invention means that the freely moving winding sleeves are once again placed in a defined position after being distributed to the two sides of the machine.

The tools for ejecting the winding sleeves can be realised in various ways. Alternative embodiments are preferred. In both instances, which are practical even without the measures and can be advantageous, only one groove is necessary for holding an entire set of winding sleeves. According to one embodiment, at least one lifting element is required for each winding sleeve, while, according to another embodiment, each winding sleeve should be fitted with at least one restrainer, preferably two restrainers. With the aid of the elements for "ejecting" the winding sleeves from the "groove", the winding sleeves are distributed to the two sides of the machine, i.e. to the corresponding winding stations.

However, it is fundamentally conceivable to design the device so that the lifting/lowering elements according to the invention distribute the winding sleeves to the two sides of the machine. This could be achieved, for example, by moving the holders of the lifting/lowering elements precisely or approximately to the winding sleeve positions in which the winding sleeves lie in the "groove" to transfer each winding sleeve directly at that location, for example by lifting the winding sleeve out of the groove. In a case such as this, the swivelling action of the lifting/lowering elements, particularly around their base point, could move them to the angular position (in relation to the vertical direction) corresponding to the angular position for transferring the winding sleeves to their clamping position; in particular, all lifting/lowering elements on one side of the machine could be moved together, while the lifting/-lowering motion of each transport device and possibly even a movement across the direction of cut sheet movement, could be executed separately, and in particular programmed, for each lifting/lowering element.

The components or procedural steps mentioned above as well as those claimed, described n the embodiments and used according to the invention are not subject to any special exceptional conditions in terms of their size, shape, material selection and technical-design or process conditions, so that the selection criteria known to the relevant application can have unlimited use.

Further details, characteristics and advantages of the subject matter of the invention are indicated in the following description of the corresponding figure according to the examples of two preferred versions of a winding sleeve feed device according to the invention.

DESCRIPTION OF THE PREFERRED EMBODIMENT

Figure 1:
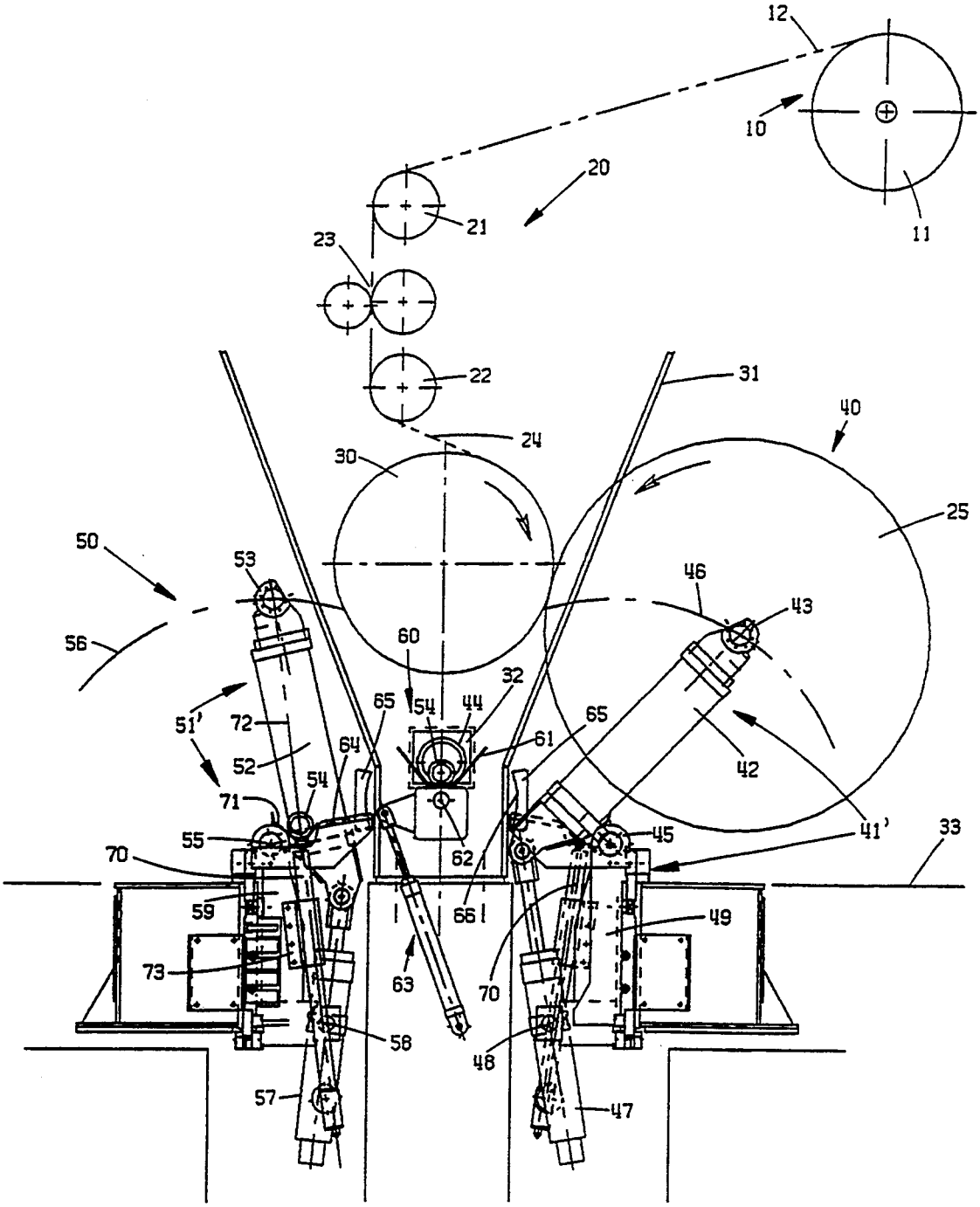
FIG. 1 shows the rewinding device of a roll-cutting machine, viewed from the end face (View A in FIG. 8) and—schematically and on a reduced scale—the remaining assemblies of the roll-cutting machine.

In the roll-cutting machine according to FIG. 1, number (10) designates a winding station in its entirety for at least one wide roll (11) for a sheet (12) of paper or similar material. The unwound, but still uncut sheet (12) is fed to a cutting station designated in its entirety with number (20), which has, among other things, a number of rolls (21), (22) . . . , at least one longitudinal cutter (23) and other essentially known elements.

The cut sheets (24), produced in the cutting station (20) by cutting the sheet lengthwise (12), are fed to a support roll (30) which extends across the entire width of the machine and can have, if necessary, a vacuum suction device for holding the ends of the cut sheets.

All winding sleeves (44) and (54) forming a single set, which are required for a single winding cycle, are fed via a feed device (60), whose general functions are known, to the roll-cutting machine, from where they are passed on to the individual winding fixtures (41) and (51). An elongated support element, which is designated for the time being as a groove (61) and extends across the entire width of the machine, below and parallel to the support roll (30), is provided for this purpose. The winding sleeves (44) and (54) can be inserted into the groove (61) from one end of the machine through an opening (32) in one of the two supports (31). This operation can be accomplished through known means such as those described in DE 38 00 702 A1.

The feed device (60) also consists of transport devices (70) which receive the winding sleeves (44) and (54) from the groove (61) and move them along a straight line to the clamping position (shown on the left-hand side of the illustration in FIG. 1), i.e. the position of the clamping devices (53) illustrated at that location. The transport devices (70) are lifting/lowering elements fitted with a two-armed holder (71), according to the embodiment described, which is fastened to the upper end of each lifting/lowering element and permits precise holding and positioning during transport to the clamping position along the broken line (72). FIG. 1 shows winding station (50) in its clamping position and winding station (40) in its winding position. However, all winding devices are normally in the same operating position.

The transport devices (70) can be designed, for example, as electromechanical lift cylinders—with or without drive (70'). This type of lifting/lowering element is available on the market in a wide variety of forms and must therefore be regarded as known devices, thus requiring no explanation in greater detail. Among other things, they permit precise movement to adjustable end positions by means of preprogramming. The transport devices need be aligned to the clamping position only once when holders (73) are provided which permit the transport devices fixtures to be set in a specific direction and these holders (73) can be fastened to the corresponding support elements (49) and (59) of the relevant winding fixture halves.

The winding sleeve (44) or (54) is transferred from the groove (61) to the holders (71) by "ejecting" it from the groove (61) and "gripping" it by the holders (71). In order to do this, the groove (61) is positioned so that it can be swivelled around an axis (62) in its longitudinal direction, with the swivel motion to one or the other side of the groove being executed by at least one swivelling device (63). This permits the groove (61) to be swivelled toward one side or the other until the winding sleeves (44) and (54) roll laterally out of the groove (61) and are passed on directly to the holders (71) via inclined planes (64). Restrainers (65) prevent winding sleeves (54) and (44) intended for the corresponding opposed winding stations (50) and (40) from being transferred to the incorrect winding station.

The construction details and movement sequences can be derived from the following description of a complete operating cycle of the rewinding device on the basis of FIGS. 2 through 10 and—for an alternative embodiment—on the basis of FIGS. 11 through 16.

Figure 2:
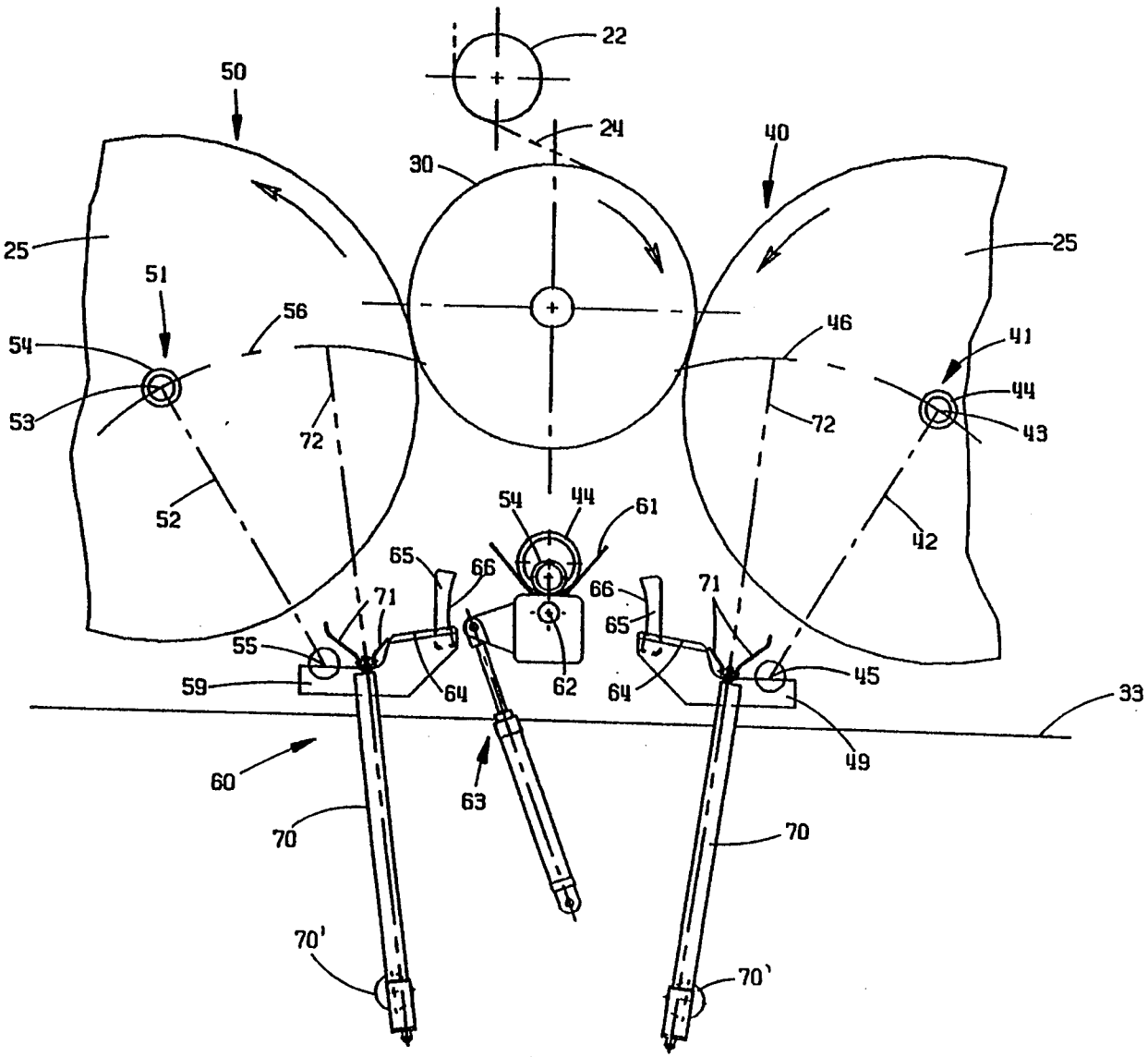
FIG. 2 through FIG. 7 show a schematic representation of a sequence of operating cycles of the winding sleeve feed device and the cut sheet winding process, otherwise viewed from the same perspective as in FIG. 1.

FIG. 2 shows the phase in which the cut sheet rolls (25) are worked shortly before they are finished. The winding sleeves (44) and (54) provided for the next rewinding cycle are already in the groove (61) of the feed devices (60). These winding sleeves have different diameters, while the two visible cut sheet rolls (25) are wound on winding sleeves with identical diameters; cut sheet rolls lying behind them, and therefore not visible, can naturally also be fitted with winding sleeves of different diameters.

Figure 3:
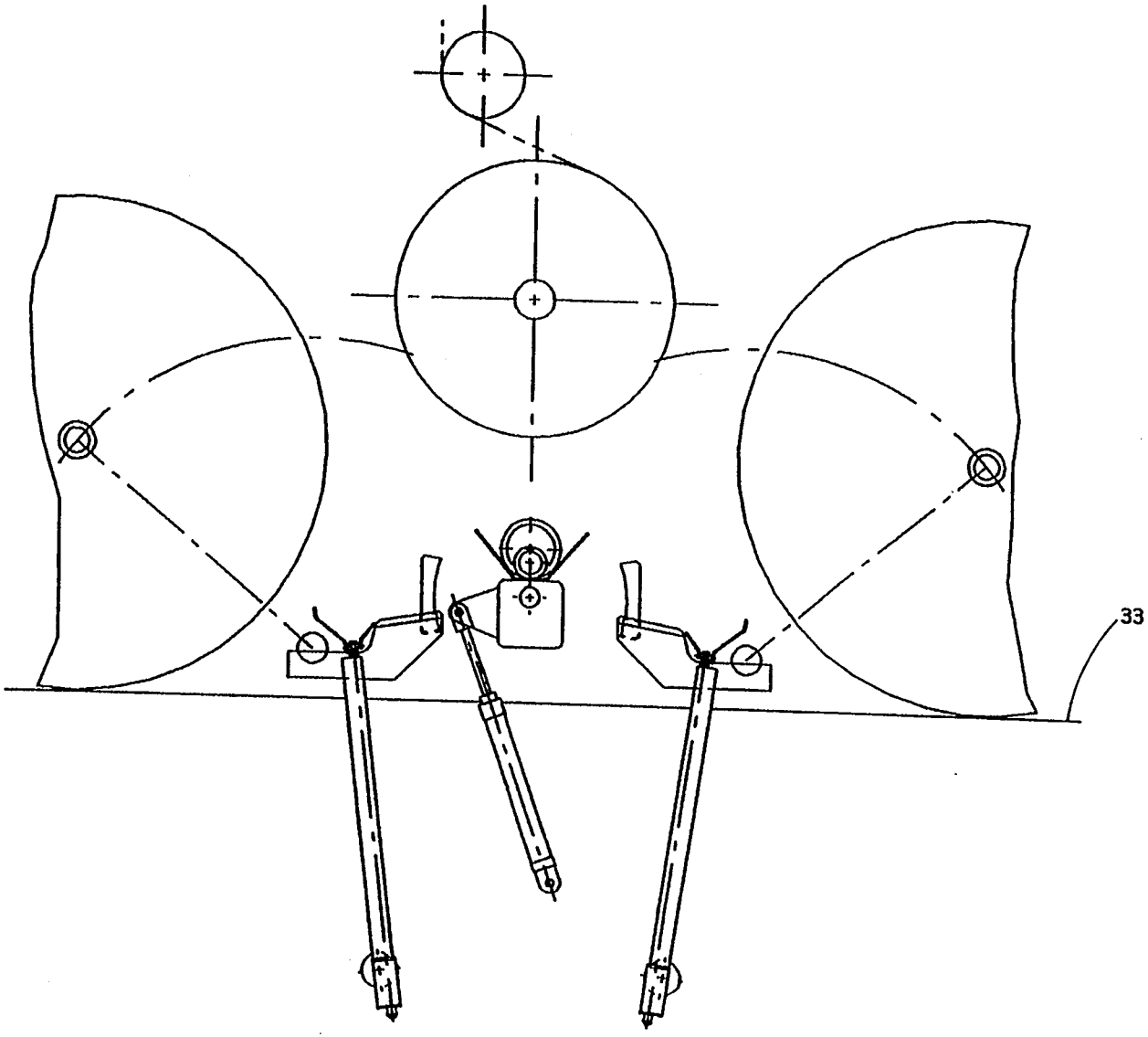

FIG. 3 demonstrates how the cut sheet rolls (25) are placed on the floor (33) by swivelling the support arms (42) and (52) at the end of a rewinding cycle. The cut sheets are then severed so that the cut sheet rolls (25) can be taken away and the next winding cycle prepared. However, this is not illustrated in detail, since it is not part of the object of the invention and—in principle—is already known.

After placing the cut sheet rolls (25) on the floor (33), the clamping devices (43) and (53) of the winding devices (41) and (51) must be released and removed from the winding sleeves in axial direction. This is done, for example, during the operating phase shown in FIG. 3, and can—in principle—also take place at a later time. The point in time at which the finished cut sheet rolls

Figure 5:
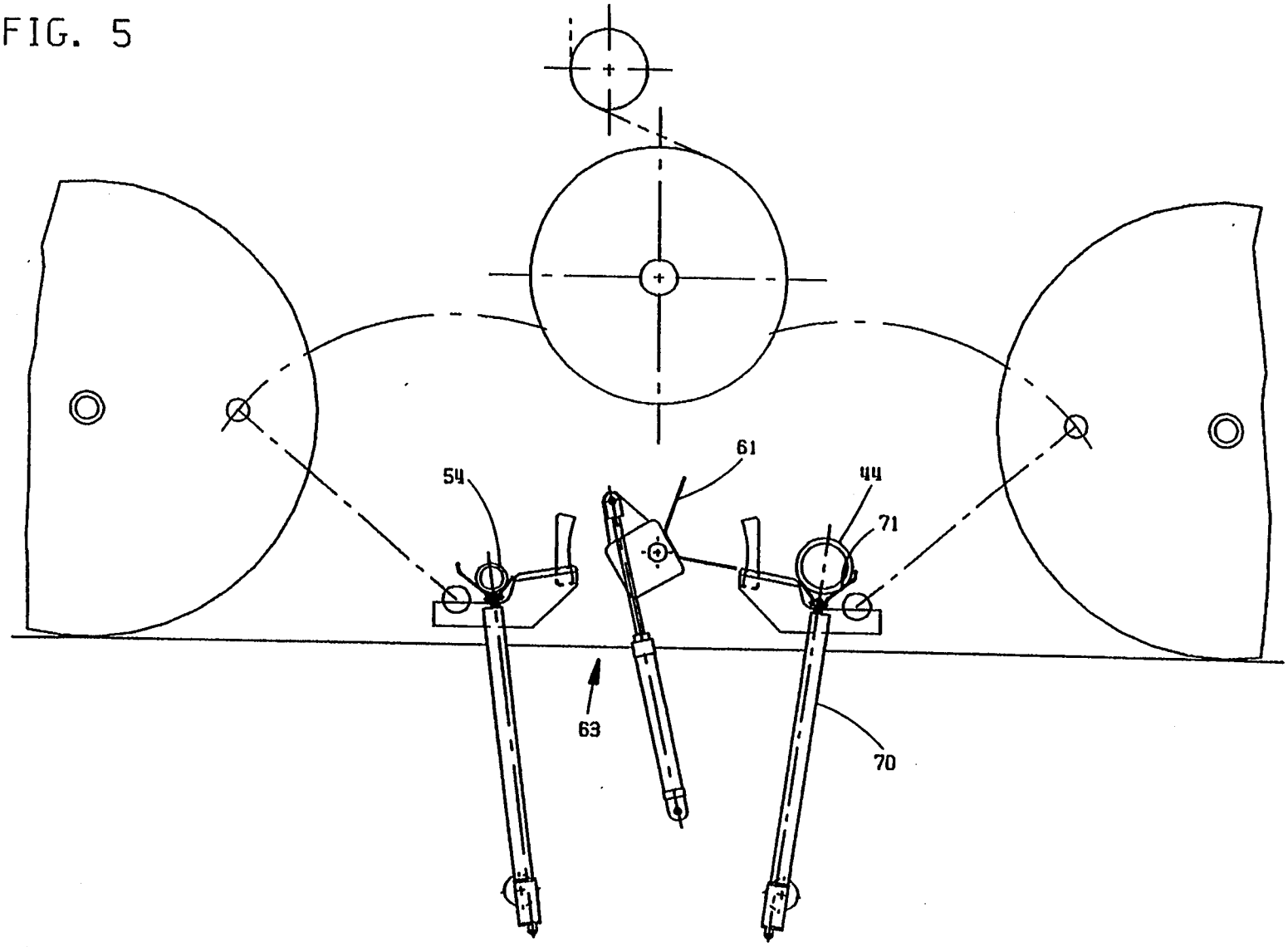

(25) are removed laterally from the winding stations (40) and (50) is essentially independent of the operating phase. FIG. 5 shows the situation after removing the rolls. The support arms (42) and (52) then move to the clamping position illustrated in FIG. 6 (and on the left-hand side of the illustration in FIG. 1) in which the new winding sleeves are to be clamped into the relevant winding fixture.

In the meantime, the process of feeding a new set of winding sleeves takes place—largely independently of the operational sequences of rewinding cut sheets, severing cut sheets, removing cut sheet rolls, removing the clamping fixtures and transporting away finished cut sheet rolls, as well as swivelling the support arms back into their clamping position. This process is described below.

Figure 8:
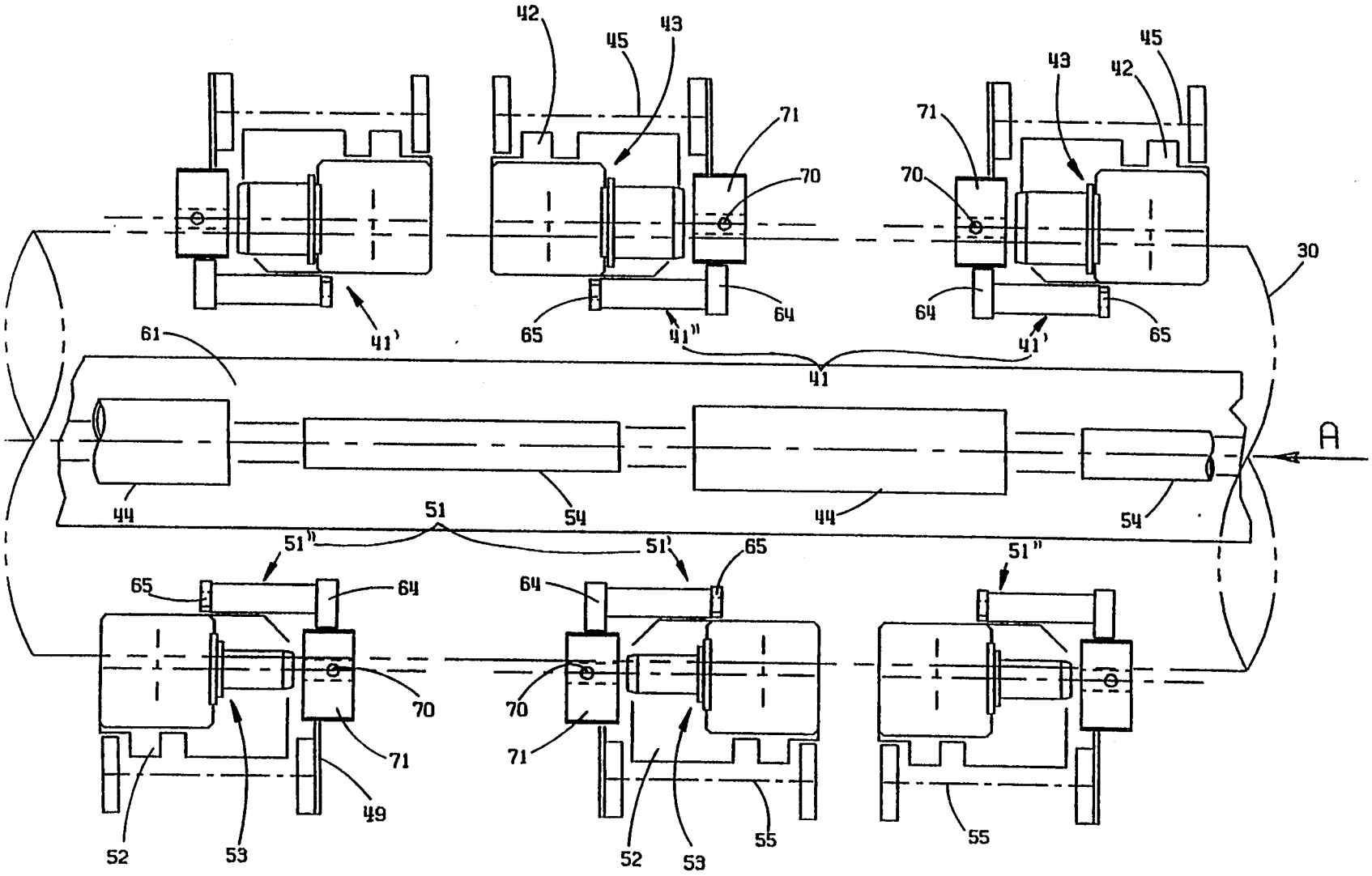
FIG. 8 through FIG. 10 show a top view (corresponding to the view in the direction of arrow B—B illustrated in FIG. 6) of a sequence of winding sleeve transfer operations from the groove to the lifting/lowering elements of the roll-cutting machine in FIGS. 1 through 7, omitting the support roll and roll-cutting station.
Figure 9:
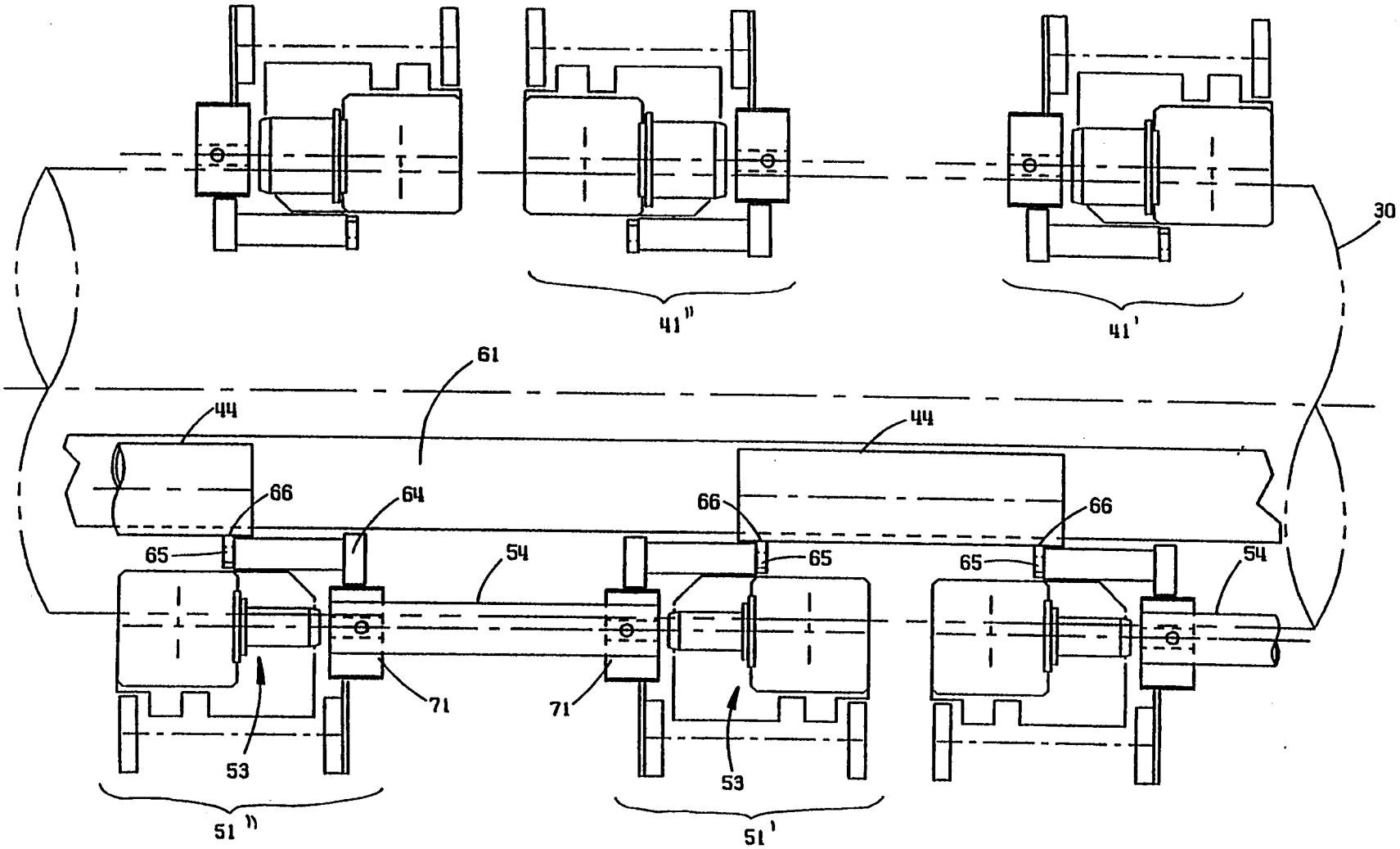
Figure 10:
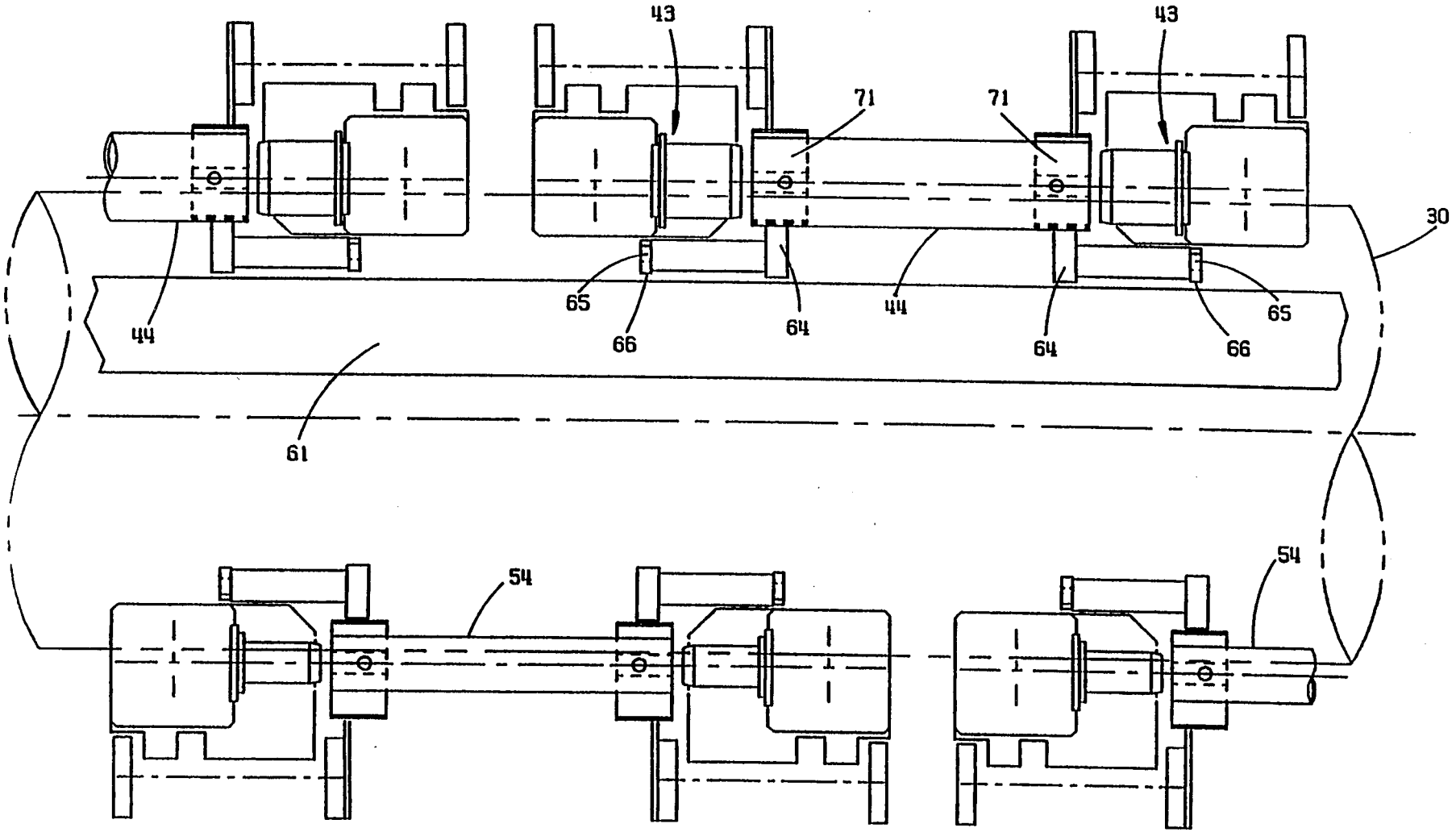

As mentioned above, a complete set of winding sleeves is first inserted into the groove (61). In order to do this, the winding sleeves should already be cut to precise lengths and are inserted into the groove (61) from one end face of the machine, sorted according to diameter and length. The winding sleeves must then be placed in their transfer position, i.e. in the position in which the winding devices (41) and (51) will later receive the winding sleeves (44) and (54). If the desired cut sheet rolls are wide enough, the winding sleeves, which are placed in a row in the groove, can lie edge to edge against one another. However, if the desired cut sheet rolls are so narrow that the clamping devices (43) and (53) on each side cannot be moved apart to a sufficient distance without causing the assemblies (41′), (41″) and (51′), (51″) of adjacent winding devices to bump into each other, it is particularly advantageous to separate the winding devices of each winding station along the length of at least one support roll (3) once the cut sheets have been severed. This will produce a sufficient lateral clearance in order to subsequently separate the related sets of assemblies (41′), (41″) and (51′), (51″) and to receive the new winding sleeves (44) and (54). This transfer position is illustrated in FIGS. 8 through 10. This preferred procedure makes it necessary to first position the winding sleeves (44) and (54) at an axial distance from one another (FIG. 8) and, after transferring and clamping these new winding sleeves, move the winding devices (41) and (51) of each winding station toward one another so that no axial gap in axial direction is left between the adjacent cut sheets (24) or cut sheet rolls (25).

The process of positioning the sleeves can be automated with slides or similar tools which are essentially known and are therefore not specifically illustrated in the figure.

Figure 4:
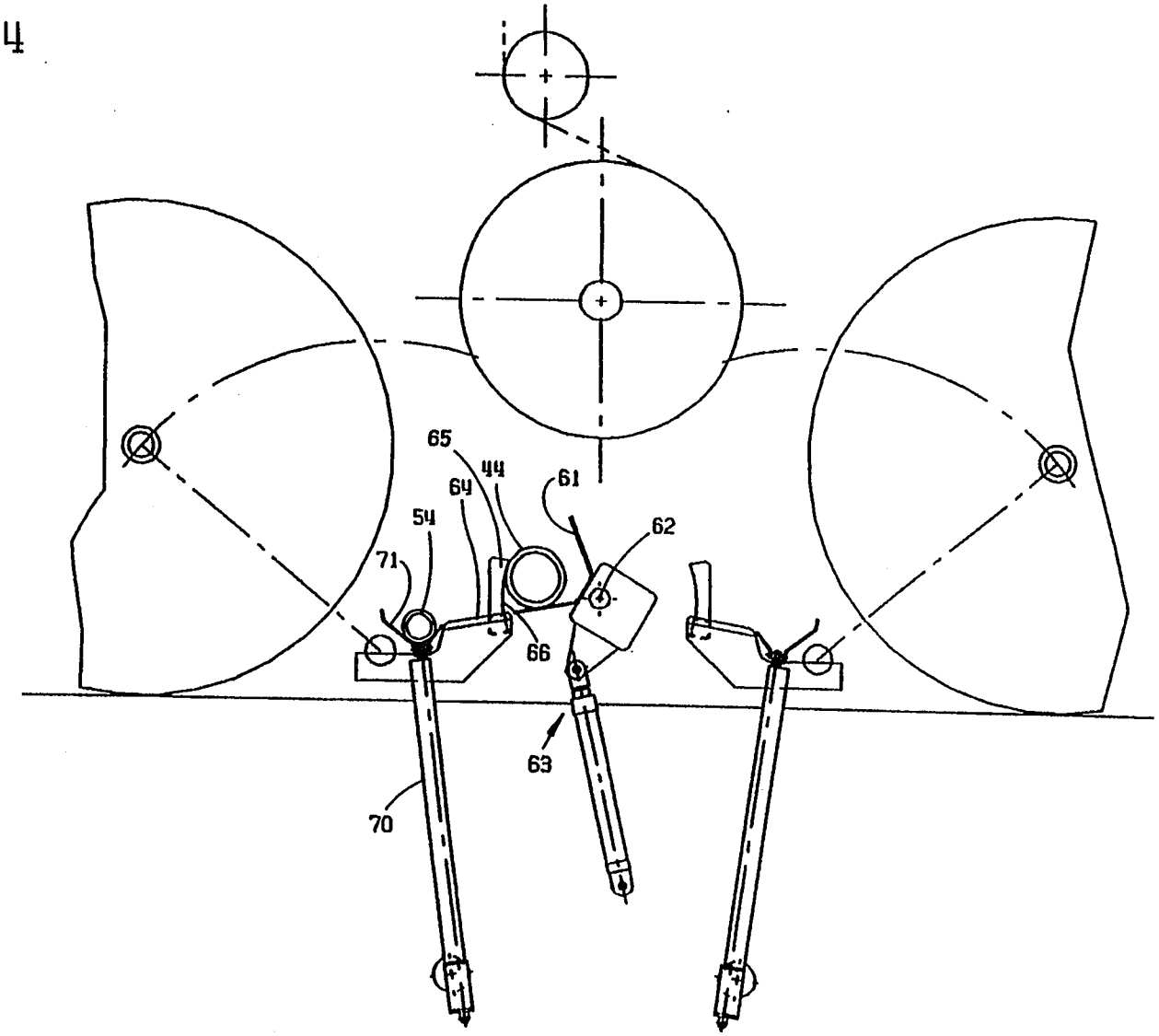

The sequence in FIGS. 3 through 5, which corresponds to the sequence in FIGS. 8 through 10, shows how the process of "ejecting" the winding sleeves from the groove (61) and "gripping" the winding sleeves with the holders (71) is carried out.

At first, all winding sleeves (44) and (54) are located in the transfer positions described in FIG. 8 in the single groove (61). If, as is preferred and as indicated in FIG. 1 as well as in FIGS. 8 through 10, the transport devices (70), the inclined planes (64) and the restrainers (65) of each assembly (41′), (41″) are permanently connected to and can be moved laterally together with the latter, the sleeves are not "ejected" from the groove (61) until the above-mentioned assemblies are in their transfer positions illustrated in FIGS. 8 through 10.

If, as illustrated in FIG. 4 (corresponding to FIG. 9), the groove (61) is swivelled toward the winding station (50) (shown on the left-hand side of the illustration), the winding sleeves (54) intended for this winding station will roll over the inclined plane (64) assigned to assemblies (51′) and (51″) and directly into the holders (71) of this winding station, while the winding sleeves (44) intended for winding station (40) are held back by the restrainers (65) of assemblies (51′) and (51″) so that, when the groove (61) is swivelled back, they remain in or return to the groove (61) in order to be subsequently "ejected" to the other side—toward winding station (40). The restrainers (65) can have curved stop surfaces (66) for this purpose.

During "ejection" and "gripping" the support arms (42) and (52) can be in a position other than the clamping position (see FIGS. 4 and 5). However, to transfer the winding sleeves from the transport devices (70), using the clamping devices (43) and (53), the support arms (42) and (52) must be swivelled into the clamping position illustrated in FIG. 6 or 15. Since the curved lines of motion of the winding axes of the support arms (42), (52) in the clamping position are cut from the essentially straight line of motion of the winding sleeve axes, the transport devices need be stopped only at specified points so that sleeves of different thicknesses can be moved to an exact central location in the clamping position. The clamping operation then begins, possibly by moving the winding fixtures laterally into the necessary winding position and moving the new winding sleeves (44) and (54) toward the support roll (30) where they come to a stop and are connected to the relevant cut sheet in an essentially known manner so that the next winding cycle can begin (FIG. 7).

The main difference between the embodiment illustrated in FIGS. 11 through 16 and the above-mentioned embodiment (according to FIGS. 1 through 10) lies in the fact that the groove (61) in the former is not swivelled around its longitudinal axis, but rather a large number of small lifting elements (67) are each positioned to the side of the groove centre and along the groove (61); these lifting elements use, for example, fluid-driven or magnetically driven rams (68) to lift the winding sleeve (44) or (54) positioned in the relevant longitudinal segment of the groove to the side until the relevant winding sleeve can be removed past a lateral, upper dead centre (69′) or (69″) formed by the groove (61).

Figure 11:
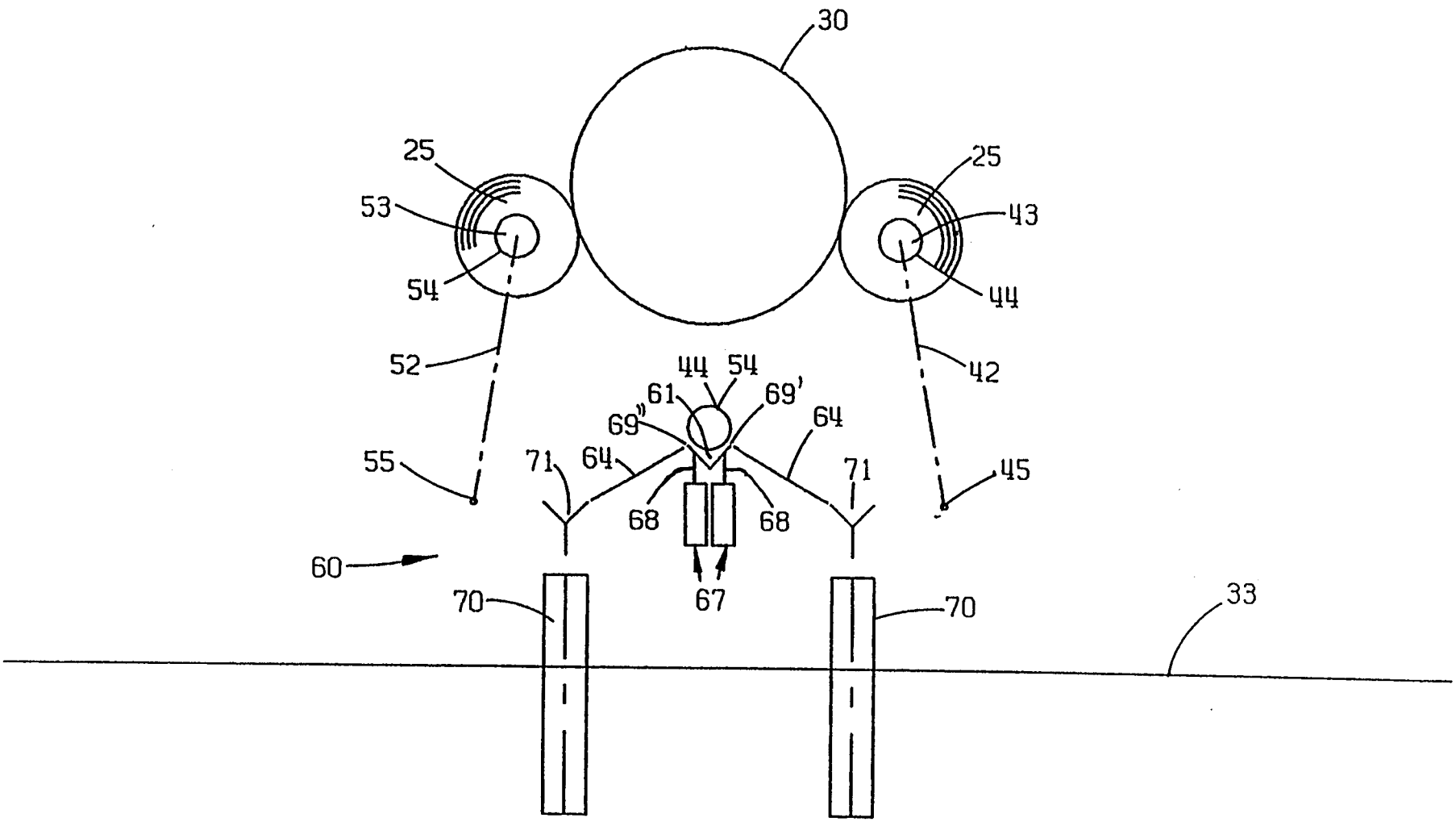
FIG. 11 through FIG. 16 show an alternative version of the winding sleeve feed device for the roll-cutting machine in FIG. 1, viewed from the same perspective as FIGS. 1 through 7, in the form of the sequence of a winding sleeve feed cycle.

The operating situation illustrated in FIG. 11 corresponds to that in FIG. 2.

Figure 12:
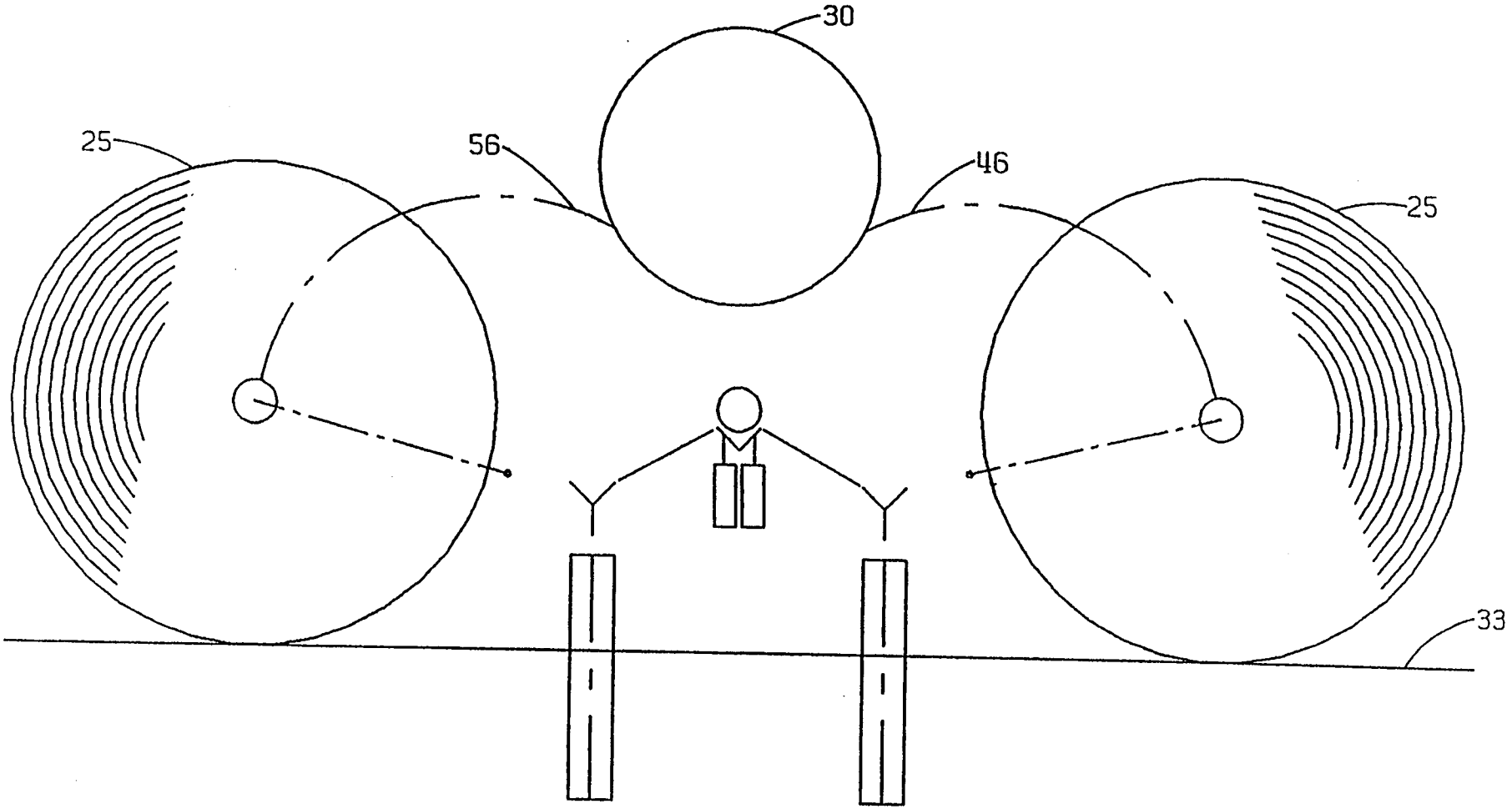

FIG. 12 corresponds to FIG. 3.

Figure 14:
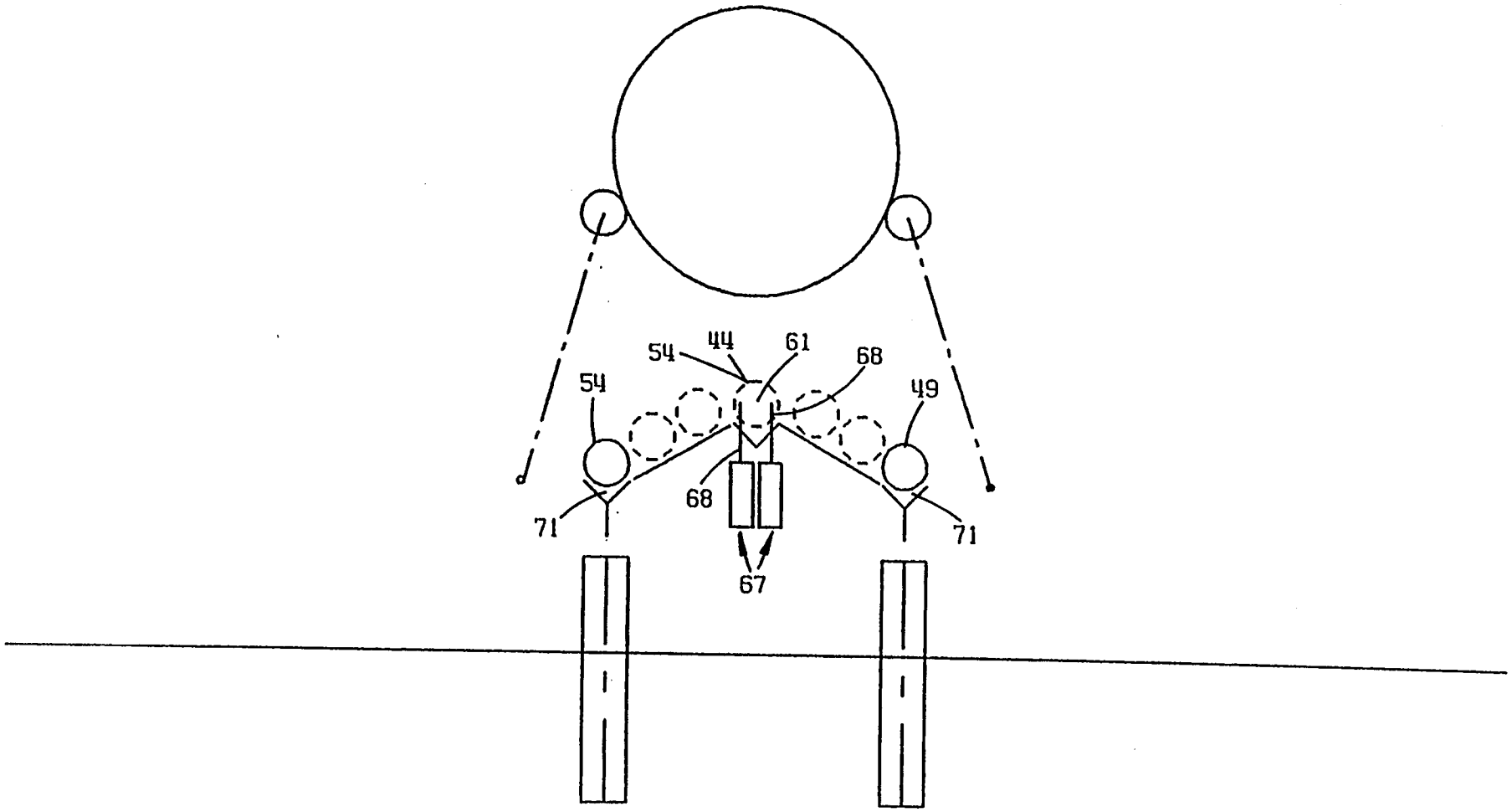

FIG. 14 corresponds to FIGS. 4 and 5.

Figure 6:
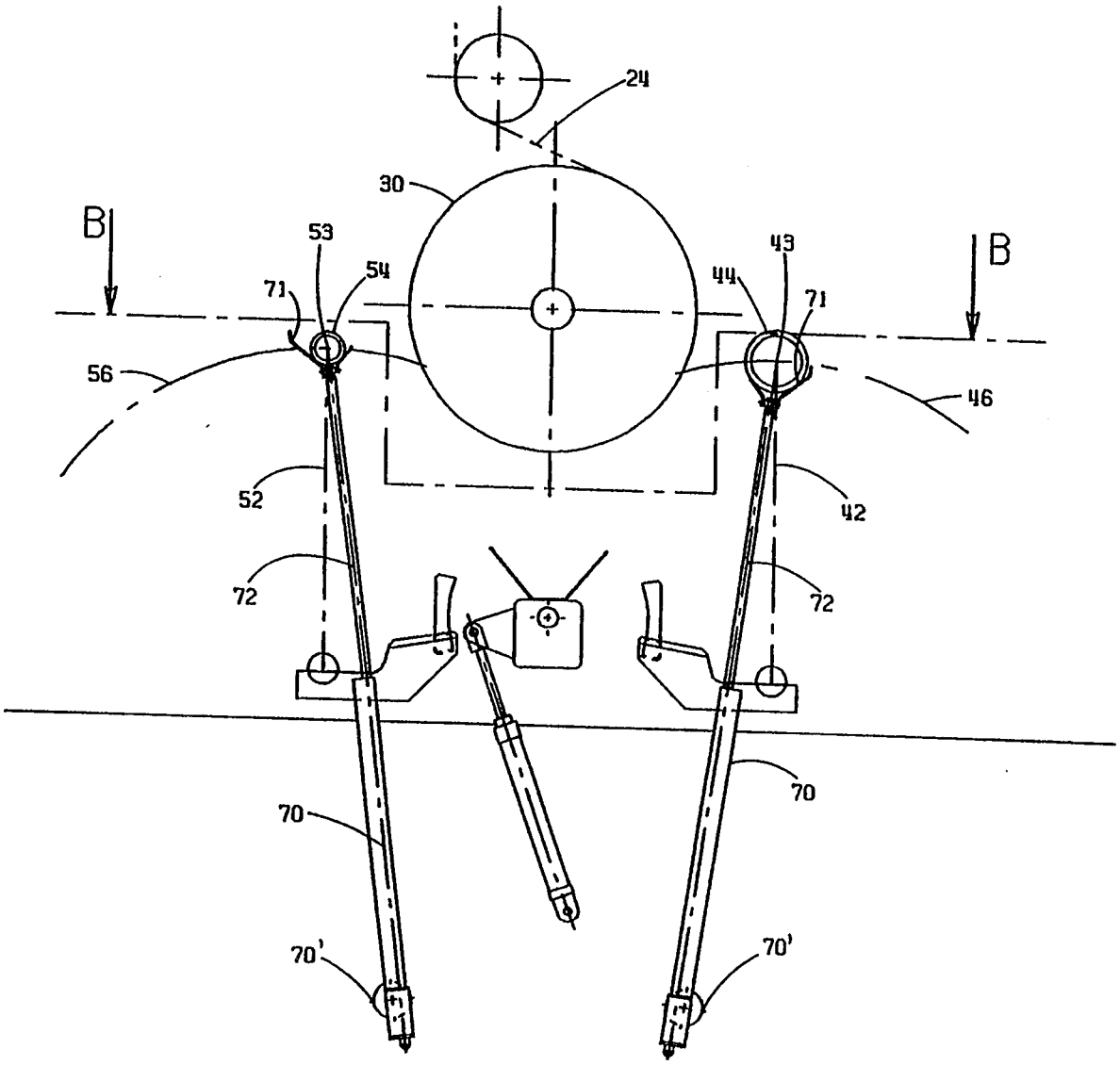
Figure 7:
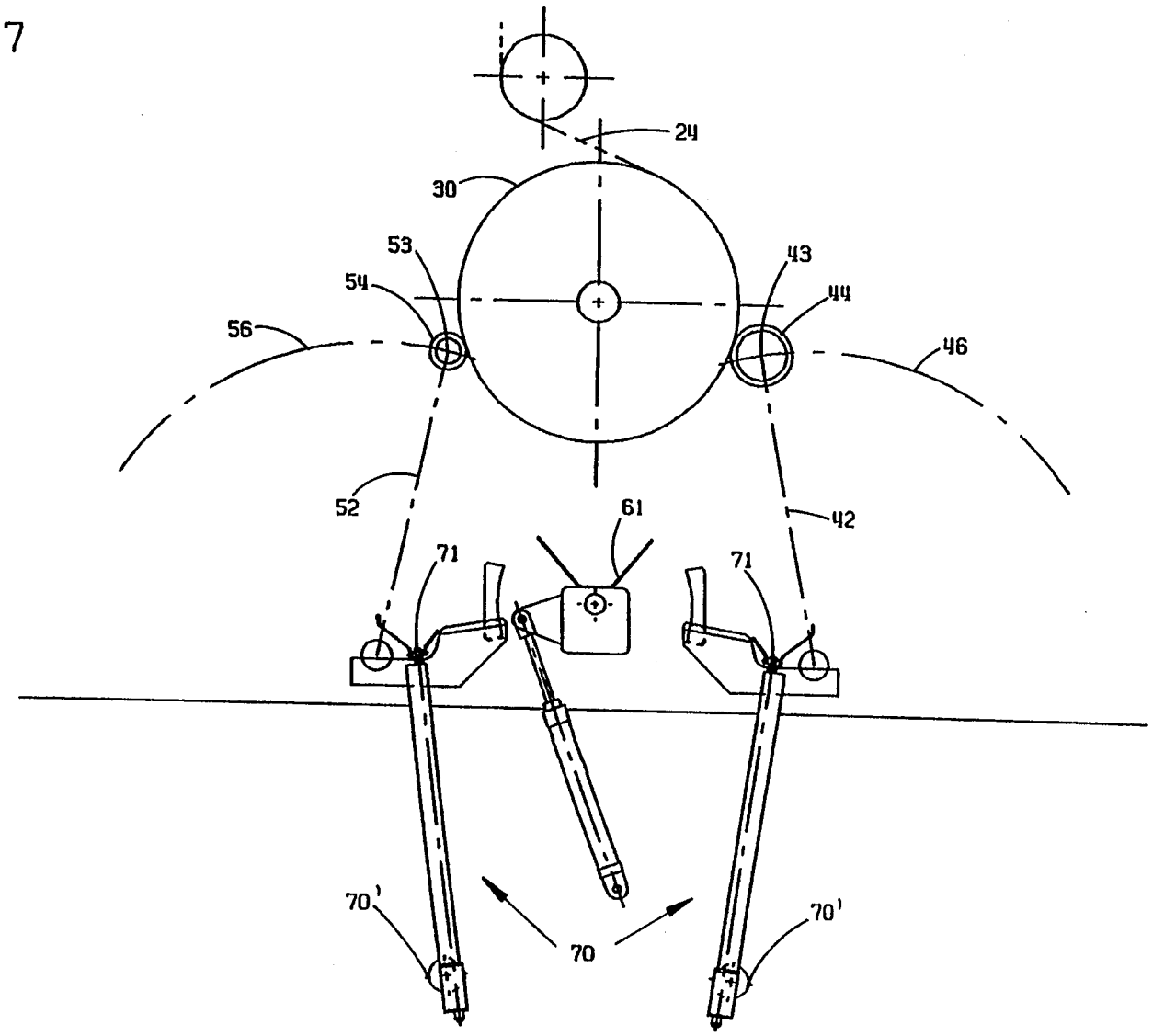
Figure 15:
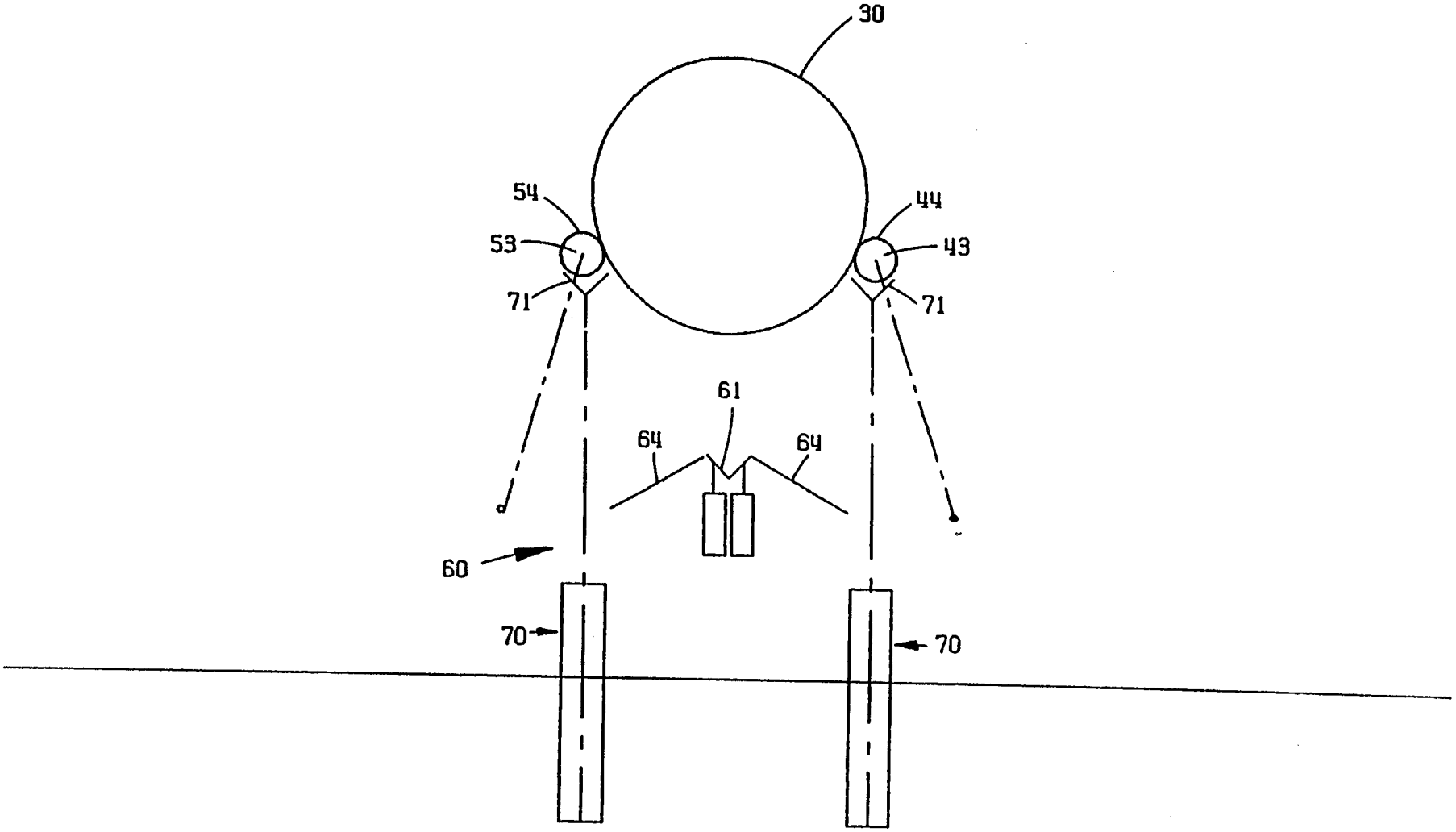
Figure 16:
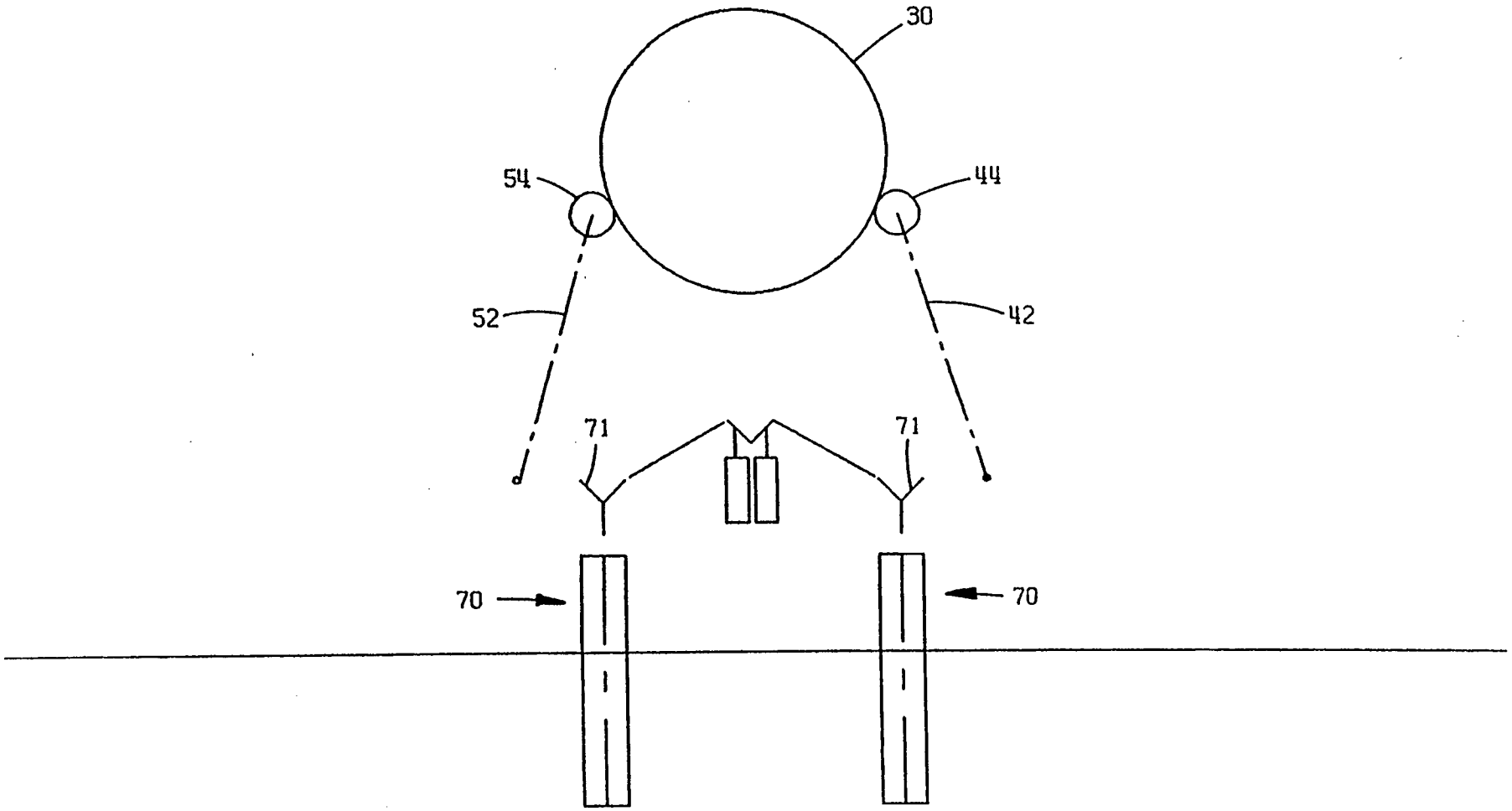

FIG. 15 corresponds to FIG. 6, with a difference in that the clamping position in FIG. 15 is combined with the winding position (corresponding to FIG. 7). For the sake of completeness, FIG. 16 additionally illustrates how the transport fixtures are returned to the transfer position at the beginning of the winding cycle.

Figure 13:
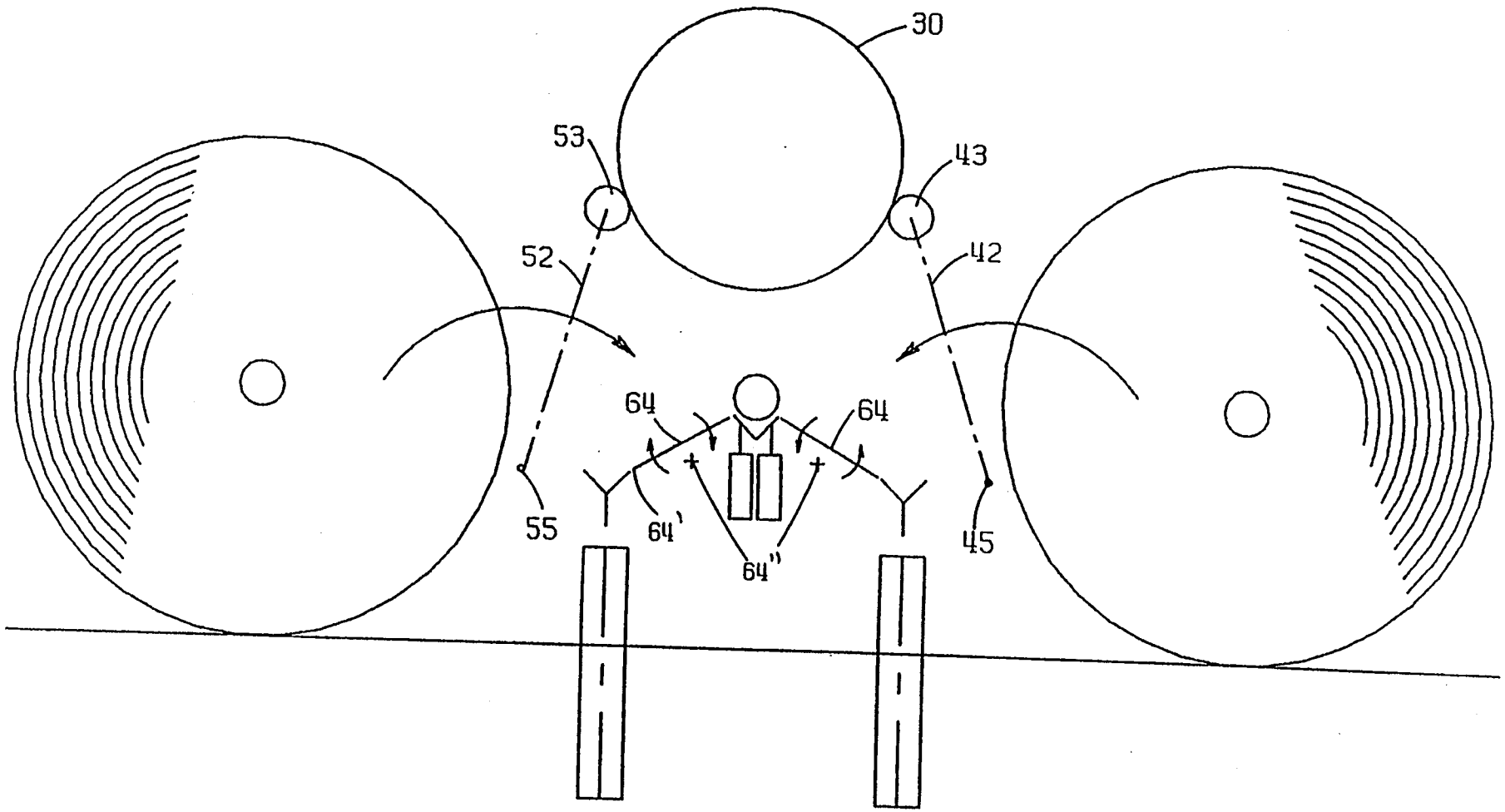

This version, illustrated in FIG. 13, has an additional special characteristic: the inclined planes (64) are assigned to the assembly containing the groove (61) and not, as shown in FIGS. 1 through 10, to the individual assemblies of the winding devices. The inclined planes (64) are formed by plate-like elements arranged sequentially at irregular intervals in the direction of machining (parallel to the backup roll axis) and have a length which is shorter than half the width of the minimum expected cut sheet width. These plates (64′) can be swivelled around an axis (64″) in the direction of the arrow illustrated in FIG. 13, so that they can be swivelled at least when they are in the position of the support arms (42) and (52).

| List of reference numbers | | | |
|---|---|---|---|
| 10 | Winding station | 56 | Swivel path of winding axis |
| 11 | Roll | 57 | Piston/cylinder device |
| 12 | Sheet | 58 | Axis |
| 20 | Cutting station | 59 | Support element |
| 21 | Roll (roller) | 60 | Feed device |
| 22 | Roll (roller) | 61 | Groove |
| 23 | Longitudinal cutter | 62 | Swivel axis |
| 24 | Cut sheets | 63 | Swivel device |
| 25 | Cut sheet roll | 64 | Inclined plane |
| 30 | Support roll | 64′ | Plates |
| 31 | Supports | 64″ | Axis |
| 32 | Opening | 65 | Restrainers |
| 33 | Floor | 66 | Stop surfaces |
| 40 | Winding station | 67 | Lifting elements |
| 41 | Winding fixture | 68 | Ram |
| 41′ | Assembly | 69′ | Dead centre |
| 41″ | Assembly | 69″ | Dead centre |
| 42 | Support arm | 70 | Transport fixtures |
| 43 | Clamping device | 70′ | Drive |
| 44 | Winding sleeve | 71 | Holders |
| 45 | Swivel axis | 72 | Line |
| 46 | Swivel path of winding axis | 73 | Holders |
| 47 | Piston/cylinder device | | |
| 48 | Axis | | |
| 49 | Support element | | |
| 50 | Winding station | A | View |
| 51 | Winding fixture | B | View |
| 51′ | Assembly | | |
| 51″ | Assembly | | |
| 52 | Support arm | | |
| 53 | Clamping device (for holding sleeve) | | |
| 54 | Winding sleeve | | |
| 55 | Swivel axis | | |

We claim:

1. A method for automatically feeding winding sleeves into a machine for receiving a traveling web, which has been slit longitudinally into a plurality of narrower, partial webs, and for winding each of the plurality of partial webs onto a sleeve and into a corresponding plurality of wound web rolls, the machine including a support roller, which is rotatable about a longitudinal axis, for supporting the web rolls as they are wound, a plurality of pairs of pivoted support arms, corresponding in number to the plurality of wound web rolls and having at least one pair of support arms disposed on either side of the support roller, comprising the steps:

1) feeding a plurality of longitudinally aligned sleeves, corresponding in number to the number of web rolls to be wound, into the machine along a loading path substantially parallel with, and substantially immediately beneath, the longitudinal axis of the support roller;

2) distributing the sleeves translationally to a holding station on either side of the loading path, in a predetermined array, to remove them from the loading path and substantially from beneath the support roller, such distributing comprising the sub-steps of:

a) restraining pre-selected sleeves from translational movement to a holding station on one side of the support roller;

b) distributing the remaining sleeves translationally to the said holding station on one side of the support roller;

c) releasing the restrained sleeves from restraint;

d) distributing the previously restrained sleeves translationally to the holding station on the other side of the support roller;

3) engaging each sleeve at either end thereof in its holding station and lifting it substantially along a straight line to region near the lateral periphery of the support roller on corresponding sides thereof;

4) releasing each sleeve to be rotatably mounted in a corresponding pair of support arms, one support arm disposed near either end of each sleeve;

5) winding each partial web onto a corresponding sleeve while the sleeve is held in its support arms in nipping engagement with the support roller;

6) rotating the pairs of support arms downwardly to bring the wound web rolls to a removal station laterally on either side of the support roller;

7) severing the webs being wound into the wound web rolls;

8) releasing the wound web rolls from the support arms.

2. Apparatus for receiving a traveling web which has been slit longitudinally into a plurality of co-traveling partial webs, and for automatically feeding a plurality of winding sleeves into the apparatus for winding each of the plurality of partial webs onto a sleeve and into a corresponding plurality of wound web rolls, including a support roller, which is rotatable about a longitudinal axis, for supporting the web rolls as they are wound, a plurality of pairs of pivoted support arms, corresponding in number to the plurality of wound web rolls, having at least one pair of support arms disposed on either side of the support roller, wherein:

a feed device means, disposed substantially beneath the support roller and extending longitudinally substantially parallel with the rotational axis of the support roller for receiving a plurality of longitudinally aligned sleeves, the feed device means being pivotally mounted for selectively pivoting in either direction about its longitudinal extension, for selectively distributing the sleeves translationally on either side of the support roller;

inclined plane means for receiving the distributed sleeves and maintaining them in a desired position at corresponding stations laterally of the feed device means;

transport means, disposed on either side of the support roller, for engaging corresponding sleeves at their corresponding stations, and lifting the sleeves along a substantially straight path to a position laterally adjacent to a respective peripheral side of the support roller;

a pair of support arms pivotally disposed, and so arranged and constructed to rotatably engage each sleeve from the transport means to wind a web roll on each sleeve.

3. Apparatus for winding a traveling web into a plurality of wound web rolls as set forth in claim 2, wherein:

the feed device means includes restraining means for selectively restraining predetermined ones of the sleeves from movement translationally in one lateral direction from the feed device means while the remaining sleeves are moved into position on the inclined plane means to be received at their stations by corresponding pairs of support arms.

* * * * *